US009918891B1

(12) United States Patent
Hallam

(10) Patent No.: US 9,918,891 B1
(45) Date of Patent: Mar. 20, 2018

(54) CONTAINER FOR A FUNERARY BOX

(71) Applicant: David Hallam, Dunnellon, FL (US)

(72) Inventor: David Hallam, Dunnellon, FL (US)

(73) Assignee: VKM International, Inc., Ocala, FL (US)

( * ) Notice: Subject to any disclaimer, the term of this patent is extended or adjusted under 35 U.S.C. 154(b) by 0 days.

(21) Appl. No.: 14/809,524

(22) Filed: Jul. 27, 2015

Related U.S. Application Data

(60) Provisional application No. 62/029,496, filed on Jul. 27, 2014, provisional application No. 62/030,440, filed on Jul. 29, 2014.

(51) Int. Cl.

| | |
|---|---|
| ***A61G 17/02*** | (2006.01) |
| ***A61G 17/00*** | (2006.01) |
| ***B65D 1/34*** | (2006.01) |
| ***B65D 19/04*** | (2006.01) |
| ***B08B 17/02*** | (2006.01) |
| ***B65D 90/24*** | (2006.01) |

(Continued)

(52) U.S. Cl.
CPC ..... *A61G 17/00* (2013.01); *A61G 17/02* (2013.01); *A61G 17/034* (2017.05); *B08B 17/025* (2013.01); *B65D 1/34* (2013.01); *B65D 19/04* (2013.01); *B65D 90/24* (2013.01); *B65D 5/46024* (2013.01); *B65D 25/2873* (2013.01); *B65D 2571/00432* (2013.01)

(58) Field of Classification Search
CPC .... A61G 17/02; B01B 19/006; B08B 17/025; B60J 11/04; B60J 11/00; B60R 9/04; B60R 9/048; B65D 19/0012; B65D 19/04; B65D 19/44; B65D 25/28; B65D 25/287; B65D 25/2873; B65D 25/2837; B65D 25/2838; B65D 90/24; B65D 7/3209; B65D 1/34; B65D 5/503; B65D 5/6673; B65D 2571/00432; B65D 2571/00987; B65D 7/08; B65D 2543/00361; E01B 19/006; E04H 6/428; F16B 5/0692; F16B 5/0685; F16B 31/002
USPC ..... 224/319, 519, 524, 527, 542; 141/86
See application file for complete search history.

(56) References Cited

U.S. PATENT DOCUMENTS

| | | | |
|---|---|---|---|
| 1,719,364 | A | 7/1929 | Gilkey |
| 1,837,249 | A | 12/1931 | Barber |
| 2,481,855 | A | 9/1949 | McKenzie |

(Continued)

OTHER PUBLICATIONS

Affordable Funeral Supply, Oversized Air Tray, viewed at http://www.affordablefuneralsupply.com/cremation/shipping-containers/oversized-air-tray/ [admitted prior art].

(Continued)

*Primary Examiner* — Anthony Stashick
*Assistant Examiner* — Mollie Impink
(74) *Attorney, Agent, or Firm* — Law Office of Steven R. Olsen, PLLC; Steven R. Olsen

(57) ABSTRACT

The invention provides a container for a funerary box. Embodiments include a tray, a jacket, retaining straps, and detachable lift handles. The tray is configured to retain fluids and also cooperate with the jacket and retaining straps to fully protect and conceal the funerary box. Preferred materials selections for the tray and jacket result in a relatively lightweight container. In embodiments of the invention, the container is configured such that the lift handles can be disposed in alternative locations on the container to facilitate handling.

18 Claims, 4 Drawing Sheets

(51) Int. Cl.
*B65D 25/28* (2006.01)
*B65D 5/46* (2006.01)

(56) References Cited

U.S. PATENT DOCUMENTS 2,811,768 A 11/1957 Axelson
3,782,619 A 1/1974 Dittbenner
4,577,377 A 3/1986 Kasai
4,800,629 A 1/1989 Ikeda
4,889,171 A * 12/1989 Minimo ..... B60J 11/00 150/166
4,922,590 A 5/1990 Yearsley
5,388,702 A * 2/1995 Jones ..... B65D 19/44 150/154
5,485,661 A 1/1996 McClure
5,775,061 A 7/1998 Enneking et al.
6,164,505 A * 12/2000 Holter ..... A45C 13/38 224/259
6,253,503 B1 7/2001 Flood
6,536,568 B1 * 3/2003 Tong ..... A45C 13/30 190/101
6,892,912 B1 * 5/2005 MacNeil ..... B60R 9/055 224/318
8,578,574 B1 11/2013 Smith
2007/0074983 A1 * 4/2007 Oh ..... A47C 31/00 206/326
2009/0189402 A1 7/2009 Swanston
2011/0042383 A1 * 2/2011 Boroughf ..... F16N 31/002 220/560.03

OTHER PUBLICATIONS

Mortuary Containers, Air Trays for Domestic and International Shipping, viewed at http://mortuarycontainers.com/2011/03/air-trays/ [admitted prior art].
Custom Air Trays, Shipping Products, viewed at: http://www.customairtrays.com/shipping-products.php [admitted prior art].
jimwilson.com, Jim Wilson JW00100, viewed athttp://www.jimwilson.com/jw00100.html [admitted prior art].
VKM International, Inc., MausoTray, viewed at: http://vkminternational.com/pdf/mausoTrayAd.pdf [admitted prior art].

* cited by examiner

CONTAINER FOR A FUNERARY BOX

CROSS-REFERENCE TO RELATED APPLICATIONS

This application claims the benefit of U.S. provisional patent Application No. 62/029,496, filed on Jul. 27, 2014, and also U.S. provisional patent Application No. 62/030,440, filed on Jul. 29, 2014.

BACKGROUND

Field of the Invention

The invention relates generally to a container, and more particularly, but without limitation, to a container that is configured for storage and/or transportation of a casket or other funerary box.

Description of the Related Art

As used herein, a funerary box is a coffin, casket, pall, or body bag used to contain human or animal remains. During transportation or storage, a funerary box may be placed inside a protective container. For instance, shipping containers are typically used to transport caskets on aircraft.

Conventional funerary box containers have many shortcomings, however. For example, such containers are often constructed from wood. Unfortunately, wooden containers are heavy, may splinter, and can harbor insects. In addition, many known containers for funerary boxes are not sufficiently secure or do not adequately retain body and embalming fluids that could escape from the funerary box. Moreover, many known funerary box containers are difficult to handle during physical transitions. A need therefore exists for an improved funerary box container.

SUMMARY OF THE INVENTION

Embodiments of the invention seek to overcome one or more of the aforementioned limitations in the known art by providing a container for a funerary box that includes a tray, a jacket, retaining straps, and detachable lift handles. The tray is configured to retain fluids and also cooperate with the jacket and retaining straps to fully protect and conceal the funerary box. Preferred materials selections for the tray and jacket result in a relatively lightweight container. In embodiments of the invention, the container is configured such that the lift handles can be disposed in alternative locations on the container to facilitate handling.

BRIEF DESCRIPTION OF THE DRAWINGS

The invention will be more fully understood from the detailed description below and the accompanying drawings, wherein.

DETAILED DESCRIPTION

The invention now will be described more fully with reference to FIGS. 1-8, in which embodiments of the invention are shown. This invention may, however, be embodied in many different forms and should not be construed as limited to the embodiments set forth herein.

Overview

Figure 1:
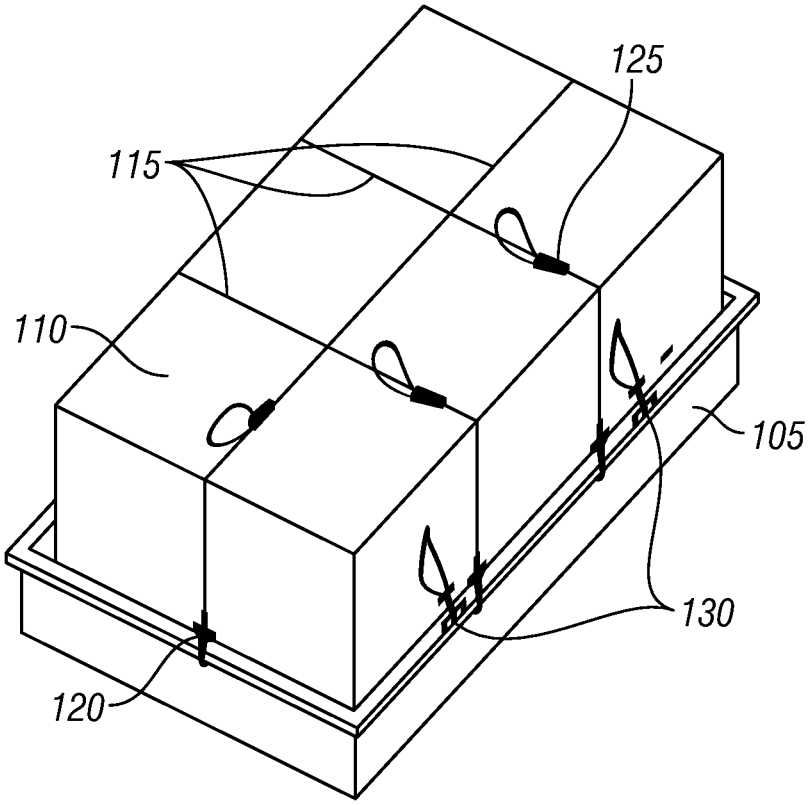
FIG. 1 is a perspective view of a container for a funerary box, according to an embodiment of the invention.

FIG. 1 is a perspective view of a container for a funerary box, according to an embodiment of the invention. In use, a casket or other funerary box (not shown) is disposed on the tray 105. A jacket 110 covers side and top surfaces of the funerary box to conceal and protect it. Multiple retention straps each include webbing 115, J hooks 120 (disposed on each end), and camlock & tightening loops 125. Multiple lift handles 130 couple to the tray 105, and preferably can be disposed in alternative coupling locations as will be described below.

Variations to the embodiment illustrated in FIG. 1 are possible. For instance, in alternative embodiments, the size, proportion, and shape of the container or any of its components could differ, according to design choice. In addition, a fewer or greater number of retention straps and/or lift handles 130 could be used, according to application requirements.

The following paragraphs further describe features of the jacket 110, tray 105, lift handles 130, and retention straps, according to embodiments of the invention.

Jacket

The jacket 110 is configured to cooperate with the tray 105 to enclose a funerary box. The jacket 110 is preferably manufactured from water-resistant (showerproof) corrugated paperboard or corrugated plastic cardboard to protect the funerary box from weather (e.g., rain or snow) and physical impact with minimal weight. In alternative embodiments, the jacket 110 may be or include, for instance, plastic sheeting (flexible or rigid), rubber sheeting, a textile blanket or tarp, or other material to achieve one or more of these same objectives. The jacket 110 is preferably opaque to conceal the contained funerary box and may also include a decorative outer surface such as a solid color, decorative pattern, texture, or other adornment.

Tray

Figure 2:
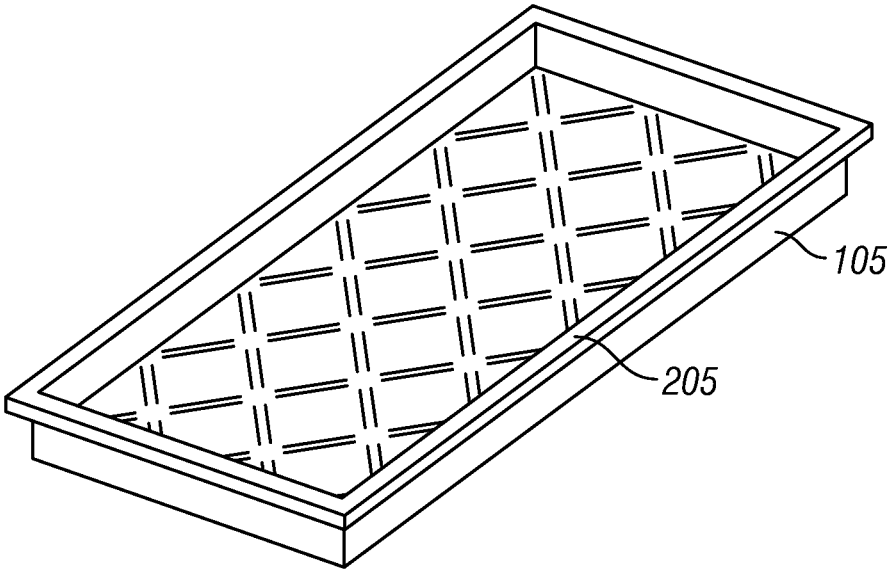
FIG. 2 is a perspective view of a tray, according to an embodiment of the invention.
Figure 3:
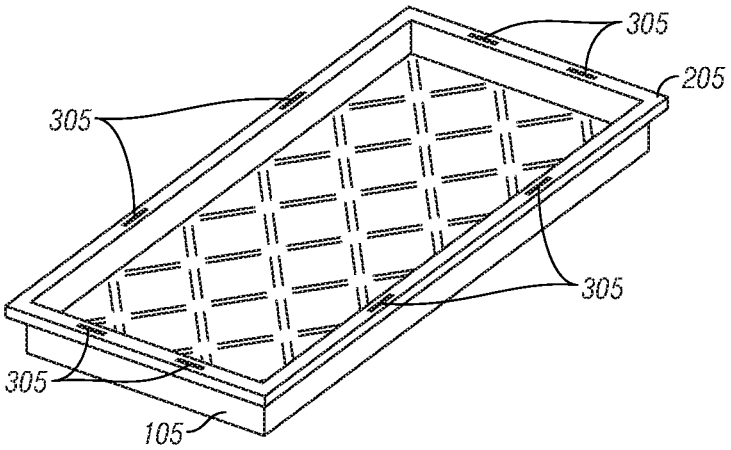
FIG. 3 is a perspective view of a tray, according to an embodiment of the invention.

FIGS. 2 and 3 provide a perspective view of the tray 105, according to embodiments of the invention. The tray 105 is preferably manufactured from high molecular weight polyethylene for high strength, light weight, and liquid retention properties. A polyethylene tray 105 could provide, for instance, up to 600 lbs of carrying capacity at a fabricated weight of approx. 16 lbs. In alternative embodiments, the tray 105 could be manufactured from another rigid plastic, fiberglass, carbon fiber, or other material(s) to achieve one or more of the desired properties listed above.

In the embodiments illustrated in FIGS. 2 and 3, the tray 105 includes sufficiently high side walls to retain a substantial volume of body or embalming fluid that might leak from a contained funerary box. For instance, the tray 105 preferably can retain up to 6.5 gallons of fluid when disposed on a level surface. Of course the tray 105 could be configured to contain more, or less, liquid. The shape of the tray 105 facilitates nesting for space-efficient storage and transportation of multiple trays 105.

As also shown in FIGS. 2 and 3, the tray 105 includes a lip 205, which is preferably a rolled lip. The lip 205 facilitates cooperation with J hooks 120 virtually anywhere along its length. In addition, as illustrated in FIG. 3, the lip 205 of the tray 105 preferably includes multiple slots 305 to cooperate with lift handles 130, as will be described more fully with reference to FIGS. 4 and 5. As used herein, a slot is a through-hole. In the embodiment illustrated in FIG. 3, the lip 205 includes 8 slots 305. The number and location of slots 305 on the lip 205 could be varied according to design choice. In alternative embodiments (not shown) the lip 205 includes at least one male connector or at least one female connector, which may be an integral part of the lip 205 (for instance molded as part of the tray 105).

The tray 105 can also be used in applications other than fully containing a funerary box during storage or transportation. For example, the tray 105 could be used in a funeral home, without the jacket 110 and retaining straps, during the preparation or storage of human remains. Moreover, the tray 105 could be used, with or without the jacket 110 and retaining straps, to contain potential fluid leaks from a casket or other funerary box in a mausoleum crypt.

Lift Handles

Figure 4:
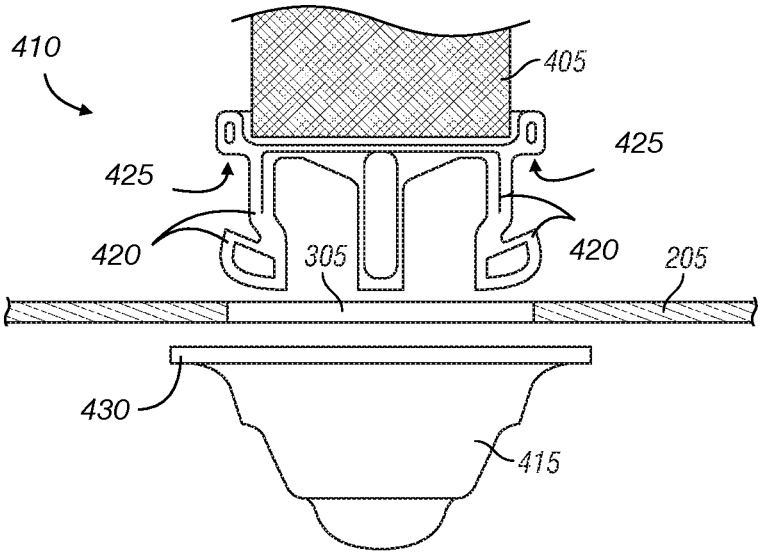
FIG. 4 is a sectional view of a portion of a lift handle, according to an embodiment of the invention.

The lift handles 130 facilitate manual lifting of the container, or of at least the tray 105, for example during transitions from one physical location to another. FIG. 4 is a sectional view of a portion of a lift handle 130, according to an embodiment of the invention. As shown therein, a lift handle 130 includes a male (plug) connector 410 coupled to a proximal end of webbing 405. The webbing 405 may be or include, for example, nylon webbing or other sufficiently strong woven fabric. The male (plug) connector 410 is configured to mate with a female (socket) connector 415 through a slot 305 in the lip 205 of the tray 105. As shown in FIG. 4, the male (plug) connector 410 includes prongs 420 and landing areas 425. The female (socket) connector 415 includes a flange 430. Together, the male (plug) connector 410 and female (socket) connector 415 form a side-release latch (buckle), and are preferably manufactured from acetal (although another plastic or other material could be used). The lift handle 130 preferably includes a loop of webbing 405 at a distal end (illustrated in FIG. 1, but not shown in FIG. 4) of the webbing 405.

Figure 5:
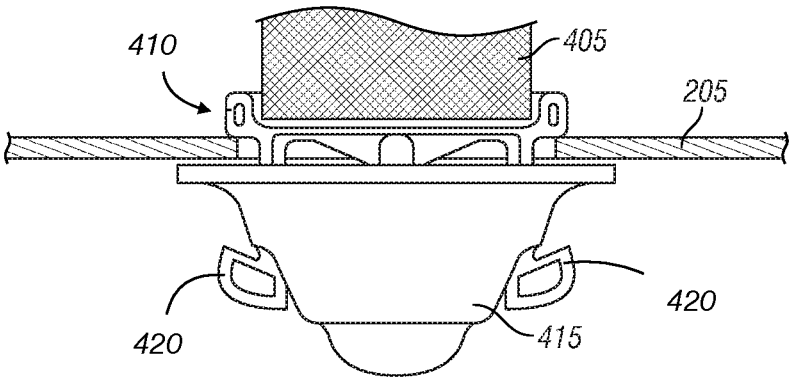
FIG. 5 is a sectional view of a portion of a lift handle, according to an embodiment of the invention.

FIG. 5 is a sectional view of a portion of a lift handle 130, according to an embodiment of the invention. In FIG. 5, the male (plug) connector 410 extends through the slot 305 in the lip 205, and is fully engaged with the female (socket) connector 415 in a latched condition. As illustrated in FIGS. 4 and 5, prongs 420 on the male (plug) connector 410 are of sufficient length to accommodate thickness of the lip 205 in the latched condition. Landing areas 425 on the male (plug) connector 410 extend beyond the dimensions of the slot 305. Likewise, the flange 430 on the female (socket) connector 415 extends beyond the dimensions of the slot 305.

In operation, a lift handle 130 may be disposed in any slot 305 in the lip 205 of the tray 105 to provide a lift handle 130 where desired. Accordingly, a container with lift handles 130 can be reconfigured for optimal handling. In addition, where appropriate, all lift handles 130 can be removed from a container, for instance during container storage or transportation, or for reuse on another container.

Variations to the lift handle 130 illustrated in FIGS. 4 and 5 are possible. For instance, in alternative embodiments, a leather, rubber, plastic, metal, or other flexible belt could be used in place of the nylon or other woven fabric webbing 405. In addition, hooks or other fasteners could be used to perform the same latching function of side-release buckle provided by the male (plug) connector 410 and female (socket) connector 415, according to design choice. Moreover, in alternative embodiments, the lift handle 130 could include a plastic, metal, or other rigid grasp feature at a distal end (not shown) of the webbing 405 rather than a loop of the webbing 405. In an alternative embodiment, the positions of the male connector 410 and female connector 415 could be switched such that the webbing 405 of the lift handle 130 is directly attached to the female connector 415. In yet another embodiment, either the male connector 410 or the female connector 415 could be formed as an integral part of the lip 205 (the mating connector being connected to the webbing 405).

Retention Straps

As described above, the purpose of the retention straps is to secure the jacket 110 to the tray 105 to contain a funerary box. FIG. 6 again illustrates the J hooks 120 and camlock & tightening loops 125 that may be associated with each one of multiple retention straps. FIG. 7 illustrates a J hook 120 in a detail, grasping the lip 205 of a tray 105. FIG. 8 provides a detailed view of a camlock buckle 805 and tightening loop 810 that cooperate to provide tension in the web 115 of the retention strap. The webbing 115 that is connected to J hooks 120 at each end, and top camlock buckle 805, may be or include, for example, nylon webbing or other sufficiently strong woven fabric.

Figure 6:
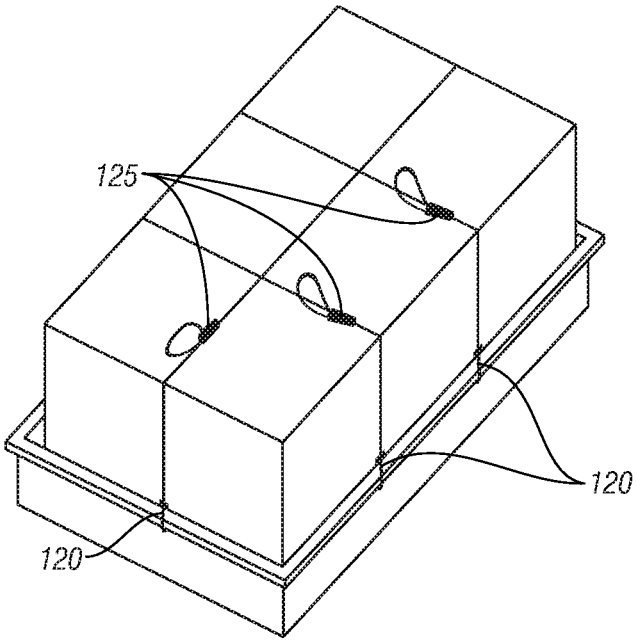
FIG. 6 is a perspective view of a container for a funerary box, according to an embodiment of the invention.
Figure 7:
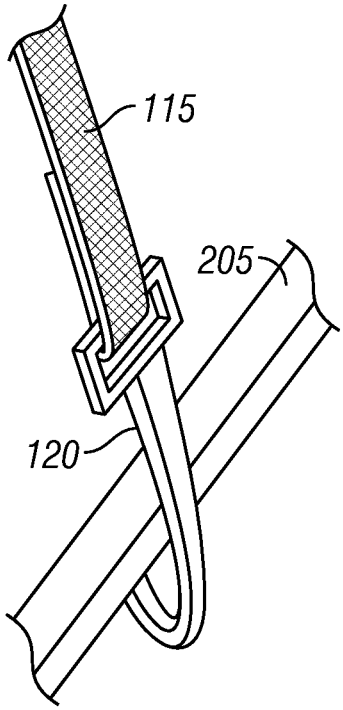
FIG. 7 is a detail view of a J hook on a retaining strap, according to an embodiment of the invention.
Figure 8:
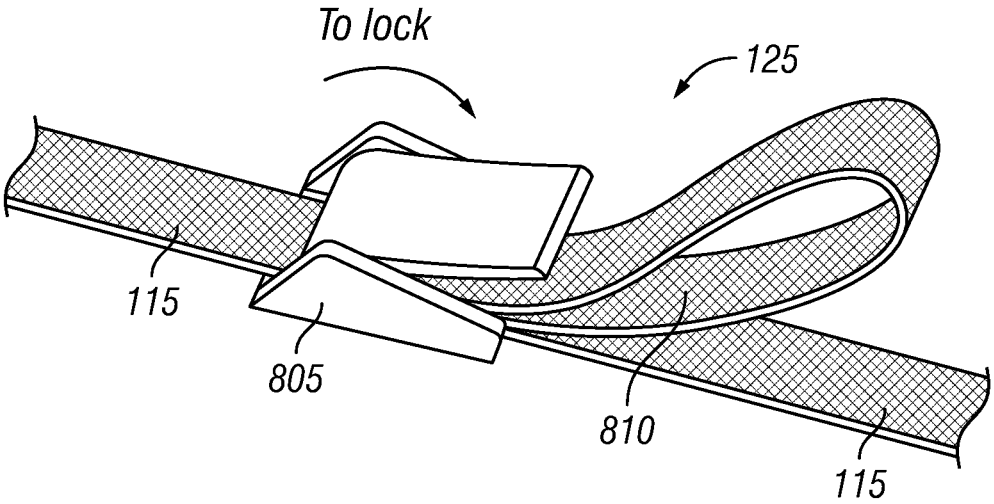
FIG. 8 is a detail view of a camlock buckle and tightening loop on a retaining strap, according to an embodiment of the invention.

Variations to the retention strap features illustrated in FIGS. 6, 7, and 8 are possible. For example, S hooks, swivel hooks, slat hooks, or other hook configurations could be used at the terminal ends of the retention straps to cooperate with the lip 205 instead of the J hook 120. In addition, D rings, O rings, triangular rings, loop rings, ratchets, over center buckles, or other hardware could be used instead of the camlock buckle 808 and tightening loop 810 (collectively, the camlock and tightening loop 125), according to design choice. In alternative embodiments, a leather, rubber, plastic, metal strapping, or other flexible belt could be used in place of the nylon or other woven fabric webbing 115.

CONCLUSION

Embodiments of the invention thus provide a container for a funerary box that contains fluids, conceals and protects the funerary box, and facilitates handling through the use of lightweight materials and reconfigurable handles. It will be apparent to those skilled in the art that modifications and variations can be made without deviating from the spirit or scope of the invention.

I claim:

1. A container for a funerary box comprising:

a plastic tray having a lip and at least one slot disposed in the lip, the funerary box being disposed on the plastic tray when the container is in use;

a jacket coupled to the tray, the funerary box being covered by the jacket when the container is in use;

at least one retaining strap disposed on an outer surface of the jacket and connected to the lip of the plastic tray; and at least one detachable handle connected to the lip, the at least one detachable handle configured to cooperate with the at least one slot, the at least one detachable handle including a male connector and a female connector, a portion of the male connector extending through the at least one slot, the male connector being detachably mated to the female connector, the male connector and the female connector forming a side release buckle, each of the male connector and the female connector being detachable from the lip.

2. The container of claim 1, wherein the plastic tray is fabricated from polyethylene.

3. The container of claim 1, wherein the jacket is water-resistant corrugated paperboard.

4. The container of claim 1, wherein the jacket is corrugated plastic cardboard.

5. The container of claim 1, wherein the jacket includes a texture that forms a decorative outer surface.

6. The container of claim 1, wherein the at least one retaining strap includes:

a webbing;

a first J hook connected to a first end of the webbing;

a second J hook connected to a second end of the webbing; and a cam lock disposed between the first J hook and the second J hook on the webbing, the first J hook and the second J hook configured to cooperate with the lip of the plastic tray.

7. The container of claim 6, wherein the webbing contains nylon.

8. The container of claim 1, wherein the at least one detachable handle includes a loop of webbing connected to one of the male connector and the female connector.

9. The container of claim 1, wherein the male connector and the female connector are fabricated from acetal.

10. The container of claim 1, wherein the male connector of the side release buckle includes a plurality of landing areas sized to extend beyond an outer dimension of the at least one slot.

11. The container of claim 1, wherein the female connector of the side release buckle includes a flange sized to extend beyond an outer dimension of the at least one slot.

12. A tray for a funerary box, comprising:

a platform, the funerary box being disposed on the platform when the tray is in use;

a wall extending from the platform, a lip being disposed on a top edge of the wall; and a detachable handle connected to the lip, the lip including a slot, the detachable handle including a male connector and a female connector, a portion of the male connector extending through the slot, the male connector being detachably mated to the female connector, the male connector and the female connector forming a side release buckle, each of the male connector and the female connector being detachable from the lip.

13. The tray of claim 12, wherein the platform and the wall are fabricated from polyethylene as an single component.

14. The container of claim 12, wherein the male connector and the female connector are fabricated from acetal.

15. The tray of claim 12, wherein the detachable handle includes a loop of webbing connected to the male connector.

16. The tray of claim 12, wherein the detachable handle includes a loop of webbing connected to the female connector.

17. The tray of claim 12, wherein the male connector of the side release buckle includes a plurality of landing areas sized to extend beyond an outer dimension of the at least one slot.

18. The tray of claim 12, wherein the female connector of the side release buckle includes a flange sized to extend beyond an outer dimension of the at least one slot.

* * * * *